US011761133B2

(12) United States Patent
Xu et al.

(10) Patent No.: US 11,761,133 B2
(45) Date of Patent: Sep. 19, 2023

(54) CONTROL METHOD FOR CLOTHING TREATMENT APPARATUS

(71) Applicants: QINGDAO HAIER DRUM WASHING MACHINE CO., LTD., Shandong (CN); Haier Smart Home Co., Ltd., Shandong (CN)

(72) Inventors: Sheng Xu, Qingdao (CN); Zhiqiang Zhao, Qingdao (CN); Kai Liu, Qingdao (CN); Shiqiang Shan, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 307 days.

(21) Appl. No.: 17/292,120

(22) PCT Filed: Oct. 30, 2019

(86) PCT No.: PCT/CN2019/114290
§ 371 (c)(1),
(2) Date: May 7, 2021

(87) PCT Pub. No.: WO2020/093917
PCT Pub. Date: May 14, 2020

(65) Prior Publication Data

US 2021/0395932 A1 Dec. 23, 2021

(30) Foreign Application Priority Data

Nov. 9, 2018 (CN) ..... 201811331393.9

(51) Int. Cl.
*D06F 33/32* (2020.01)
*D06F 35/00* (2006.01)
(Continued)

(52) U.S. Cl.
CPC ..... *D06F 33/32* (2020.02); *D06F 33/36* (2020.02); *D06F 33/37* (2020.02); *D06F 35/00* (2013.01);
(Continued)

(58) Field of Classification Search
None
See application file for complete search history.

(56) References Cited

U.S. PATENT DOCUMENTS

2009/0255146 A1* 10/2009 Klug ..... D06F 58/203 34/132
2010/0000112 A1* 1/2010 Carow ..... D06F 58/44 34/527
(Continued)

FOREIGN PATENT DOCUMENTS

CN 106032613 A 10/2016
CN 107034630 A 8/2017
(Continued)

OTHER PUBLICATIONS

International Search Report dated Feb. 5, 2020 in corresponding International Application No. PCT/CN2019/114290; 4 pages.

*Primary Examiner* — Spencer E. Bell
(74) *Attorney, Agent, or Firm* — Maier & Maier, PLLC

(57) ABSTRACT

A control method for a clothing treatment apparatus. The clothing treatment apparatus includes an air washing device for performing air washing on clothing. The control method includes: obtaining the material of clothing; obtaining the type of a clothing detergent; obtaining the type of a stain on the clothing; and determining a parametric range of air washing according to the material of the clothing, the type of the clothing detergent, and the type of the stain on the clothing. The embodiments allow clothing to be subjected to air washing treatment within an optical parametric range, i.e., a detergent can exert an activation function to the
(Continued)

greatest extent, and also allows a stain to be removed and cleaned within the most suitable parametric range to improve the clothing decontamination capability, thereby improving a clothing treatment effect and improving user experience.

4 Claims, 2 Drawing Sheets

(51) Int. Cl.

| | |
|---|---|
| ***D06F 33/36*** | (2020.01) |
| ***D06F 105/42*** | (2020.01) |
| ***D06F 105/22*** | (2020.01) |
| ***D06F 105/20*** | (2020.01) |
| ***D06F 103/06*** | (2020.01) |
| ***D06F 103/22*** | (2020.01) |
| ***D06F 33/37*** | (2020.01) |

(52) U.S. Cl.
CPC ..... *D06F 35/006* (2013.01); *D06F 2103/06* (2020.02); *D06F 2103/22* (2020.02); *D06F 2105/20* (2020.02); *D06F 2105/22* (2020.02); *D06F 2105/42* (2020.02)

(56) References Cited

U.S. PATENT DOCUMENTS

| | | | | |
|---|---|---|---|---|
| 2010/0017968 | A1* | 1/2010 | Kim | D06F 35/005 8/137 |
| 2019/0010647 | A1* | 1/2019 | Aurora | D06F 34/30 |

FOREIGN PATENT DOCUMENTS

| | | | |
|---|---|---|---|
| CN | 207552720 | U | 6/2018 |
| CN | 108374269 | A | 8/2018 |
| KR | 20180065594 | A | 6/2018 |

* cited by examiner

CONTROL METHOD FOR CLOTHING TREATMENT APPARATUS

FIELD

The present disclosure belongs to the technical field of clothing treatment, and specifically provides a control method for a clothing treatment apparatus.

BACKGROUND

A clothing treatment apparatus is an apparatus that is capable of washing, drying, sterilizing, and/or deodorizing clothing. With the continuous improvement of production levels and ongoing increase of user needs, air washing can be used for some high-end material clothing for treatment. Air washing refers to the construction of multi-dimensional data relationships and control methods by combining interactions of a humidity field, a temperature field, and an airflow field with the influence mechanisms of physical and chemical properties of different textile clothing materials and stain interface properties. Based on CFD (Computational Fluid Dynamics) aerodynamic analysis, the technologies of uniform wind structure, micro-liquid phase vaporization, inner cylinder pressure forming, etc., are used to realize non-destructive caring of clothing fibers by micro-vapor molecules, and realize caring of high-end clothing such as sterilization, mite removal, color protection, leveling, fluffing up and nursing by air washing, belonging to the world's leading new technology.

In the prior art, different air washing operations are generally performed only based on the material of the clothing. However, the best way to treat the clothing that has been impregnated by stains is to apply a detergent on the clothing, and then treat the clothing in combination with air washing. In this cleaning method, the treatment ranges of the optimal temperature, humidity and other parameters corresponding to different detergent are different, and the treatment ranges of the optimal temperature, humidity and other parameters for washing away different stains are also different. Therefore, performing the corresponding air washing program only based on the material of the clothing cannot bring the detergent into full play, and at the same time, the stains may be treated within inappropriate parameter ranges, so the stains will not be completely removed in the clothing after the air washing treatment, which will greatly affect the clothing treatment effect and lead to poor user experience.

Accordingly, there is a need for a new control method for clothing treatment apparatus in the art to solve the above problem.

SUMMARY

In order to solve the above problem in the prior art, that is, in order to solve the problem that the existing clothing treatment apparatuses with an air washing function have poor clothing treatment effect, the present disclosure provides a control method for a clothing treatment apparatus, the clothing treatment apparatus including an air washing device capable of performing air washing on clothing, and the control method including: obtaining a material of the clothing; obtaining a type of a clothing detergent; obtaining a type of a clothing stain; and determining a parameter range of air washing according to the material of the clothing, the type of the clothing detergent and the type of the clothing stain.

In a preferred technical solution of the above control method, the parameter range of air washing is a temperature range of air washing, and the step of "determining the parameter range of air washing according to the material of the clothing, the type of the clothing detergent and the type of the clothing stain" specifically includes: obtaining an optimal temperature treatment range corresponding to a current clothing material according to the material of the clothing; obtaining an optimal temperature treatment range corresponding to a current detergent type according to the type of the clothing detergent; obtaining an optimal temperature treatment range corresponding to a current stain type according to the type of the clothing stain; and performing an intersection operation on the optimal temperature treatment range corresponding to the current clothing material, the optimal temperature treatment range corresponding to the current detergent type, and the optimal temperature treatment range corresponding to the current stain type, and deriving the temperature range of the air washing according to the result of the intersection operation.

In a preferred technical solution of the above control method, after the step of "deriving the temperature range of the air washing according to the result of the intersection operation", the control method further includes: air washing the clothing at a preset temperature, the preset temperature being the lowest temperature within the temperature range of the air washing.

In a preferred technical solution of the above control method, the parameter range of the air washing is a humidity range of air washing, and the step of "determining the parameter range of air washing according to the material of the clothing, the type of the clothing detergent and the type of the clothing stain" specifically includes: obtaining an optimal humidity treatment range corresponding to a current clothing material according to the material of the clothing; obtaining an optimal humidity treatment range corresponding to a current detergent type according to the type of the clothing detergent; obtaining an optimal humidity treatment range corresponding to a current stain type according to the type of the clothing stain; and performing an intersection operation on the optimal humidity treatment range corresponding to the current clothing material, the optimal humidity treatment range corresponding to the current detergent type, and the optimal humidity treatment range corresponding to the current stain type, and deriving the humidity range of the air washing according to the result of the intersection operation.

In a preferred technical solution of the above control method, after the step of "deriving the humidity range of the air washing according to the result of the intersection operation", the control method further includes: air washing the clothing at a preset humidity, the preset humidity being the lowest humidity within the humidity range of the air washing.

In a preferred technical solution of the above control method, the parameter range of the air washing includes a temperature range and a humidity range of air washing, and the step of "determining the parameter range of air washing according to the material of the clothing, the type of the clothing detergent and the type of the clothing stain" specifically includes: obtaining an optimal temperature treatment range corresponding to a current clothing material according to the material of the clothing; obtaining an optimal humidity treatment range corresponding to the current clothing material according to the material of the clothing; obtaining an optimal temperature treatment range corresponding to a current detergent type according to the type of the clothing detergent; obtaining an optimal humidity treatment range corresponding to the current detergent type according to the type of the clothing detergent; obtaining an optimal temperature treatment range corresponding to a current stain type according to the type of the clothing stain; obtaining an optimal humidity treatment range corresponding to the current stain type according to the type of the clothing stain; and performing an intersection operation on the optimal temperature treatment range corresponding to the current clothing material, the optimal temperature treatment range corresponding to the current detergent type, and the optimal temperature treatment range corresponding to the current stain type, performing an intersection operation on the optimal humidity treatment range corresponding to the current clothing material, the optimal humidity treatment range corresponding to the current detergent type, and the optimal humidity treatment range corresponding to the current stain type, and deriving the temperature range and the humidity range of the air washing according to the results of the intersection operations.

In a preferred technical solution of the above control method, after the step of "deriving the temperature range and the humidity range of the air washing according to the results of the intersection operations", the control method further includes: air washing the clothing at a preset temperature and a preset humidity, the preset temperature being the lowest temperature within the temperature range of the air washing, and the preset humidity being the lowest humidity within the humidity range of the air washing.

In a preferred technical solution of the above control method, before the step of "obtaining the type of the clothing detergent", the control method further includes: applying the clothing detergent to the clothing.

In a preferred technical solution of the above control method, after the air washing operation is performed on the clothing, the control method further includes: applying a clothing nursing agent to the clothing.

In a preferred technical solution of the above control method, in the process of performing the air washing operation on the clothing, the control method further includes: turning the clothing over.

It can be understood by those skilled in the art that in the preferred technical solution of the present disclosure, the material of the clothing, the type of the clothing detergent and the type of the clothing stain are obtained, and then the parameter range of the air washing is determined, so that the clothing can be air washed within the optimal parameter range, that is, the detergent can exert the maximum activation effect; at the same time, the stain is also removed completely within the most suitable parameter range, which improves the ability of decontaminating the clothing, thereby improving the effect of clothing treatment and enhancing the user experience.

Further, by performing an intersection operation on the optimal temperature treatment range corresponding to the current clothing material, the optimal temperature treatment range corresponding to the current detergent type, and the optimal temperature treatment range corresponding to the current stain type, the optimal temperature range of the air washing is derived, so that the clothing can be washed within the optimal temperature range. In this way, not only the clothing will not be damaged, but also the role of the detergent can be brought into full play; at the same time, the stain on the clothing can be removed completely, which improves the effect of clothing treatment and enhances the user experience.

Further, by selecting the lowest temperature within the optimal temperature range of the air washing to air wash the clothing, not only the effect of clothing treatment can be ensured, but also the clothing treatment apparatus can be made more energy-saving, which reduces energy consumption and further improves the user experience.

Further, by performing an intersection operation on the optimal humidity treatment range corresponding to the current clothing material, the optimal humidity treatment range corresponding to the current detergent type, and the optimal humidity treatment range corresponding to the current stain type, the optimal humidity range of the air washing is derived, so that the clothing can be washed within the optimal humidity range. In this way, not only the clothing will not be damaged, but also the role of the detergent can be brought into full play; at the same time, the stain on the clothing can be removed completely, which improves the effect of clothing treatment and enhances the user experience.

Further, by selecting the lowest humidity within the optimal humidity range of the air washing to air wash the clothing, not only the effect of clothing treatment can be ensured, but also the clothing treatment apparatus can be made more energy-saving, which reduces energy consumption and further improves the user experience.

Further, by performing an intersection operation on the optimal temperature treatment range corresponding to the current clothing material, the optimal temperature treatment range corresponding to the current detergent type, and the optimal temperature treatment range corresponding to the current stain type and performing an intersection operation on the optimal humidity treatment range corresponding to the current clothing material, the optimal humidity treatment range corresponding to the current detergent type, and the optimal humidity treatment range corresponding to the current stain type, the optimal temperature range and the optimal humidity range of the air washing are derived, so that the clothing can be washed within the optimal temperature range and the optimal humidity range. In this way, not only the clothing will not be damaged, but also the role of the detergent can be brought into full play; at the same time, the stain on the clothing can be removed completely, which improves the effect of clothing treatment and enhances the user experience.

Further, by selecting the lowest temperature within the optimal temperature range and the lowest humidity within the optimal humidity range of the air washing to air wash the clothing, not only the effect of clothing treatment can be ensured, but also the clothing treatment apparatus can be made more energy-saving, which reduces energy consumption and further improves the user experience.

Further, after the air washing operation is performed on the clothing, applying the clothing nursing agent to the clothing can avoid secondary pollution of the clothing, so that the clothing can be kept in a clean state for a long time and protected from being contaminated by stain.

Further, in the process of performing the air washing operation on the clothing, the clothing is turned over to enable the clothing to fully contact with the air, so that the clothing is washed clean without dead ends, that is, impurities such as the dust on the clothing are removed under the action of friction, which improves the clothing treatment effect and clothing treatment efficiency, reduces the time of the air washing, makes the clothing treatment apparatus more energy-saving, and further improves the user experience.

DETAILED DESCRIPTION OF THE EMBODIMENTS

Preferred embodiments of the present disclosure will be described below with reference to the drawings. It should be understood by those skilled in the art that these embodiments are only used to explain the technical principles of the present disclosure, and are not intended to limit the scope of protection of the present disclosure.

It should also be noted that in the description of the present disclosure, unless otherwise clearly specified and defined, terms "arrange", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem that the existing clothing treatment apparatuses with an air washing function have poor clothing treatment effect pointed out in the background art, the present disclosure provides a control method for a clothing treatment apparatus, which aims at improving the ability of decontaminating the clothing, thereby improving the clothing treatment effect and enhancing the user experience.

Specifically, the clothing treatment apparatus of the present disclosure includes a cabinet and an air washing device provided on the cabinet, and the air washing device can perform air washing on the clothing. The air washing device may adopt a condensing structure, or a heat pump structure, or another structure. For example, when the air washing device adopts the condensing structure, an air duct may be arranged in the cabinet, a condenser and a heater (such as an electric heating pipe, etc.) may be arranged in the air duct, and the temperature of air washing may be adjusted through the effect of condensing and heating; when the air washing device adopts the heat pump structure, an air duct may be arranged in the cabinet, a condenser and an evaporator may be arranged inside the air duct, and the condenser, the evaporator and a compressing mechanism form a refrigerant circulation system, that is, the temperature of air washing is adjusted through the evaporator and the condenser. In addition, a steam generator may also be arranged in the cabinet to adjust the humidity of the air washing. Those skilled in the art may flexibly set the specific structure of the air washing device in practical applications, as long as the air washing device can perform air washing on the clothing.

Figure 1:
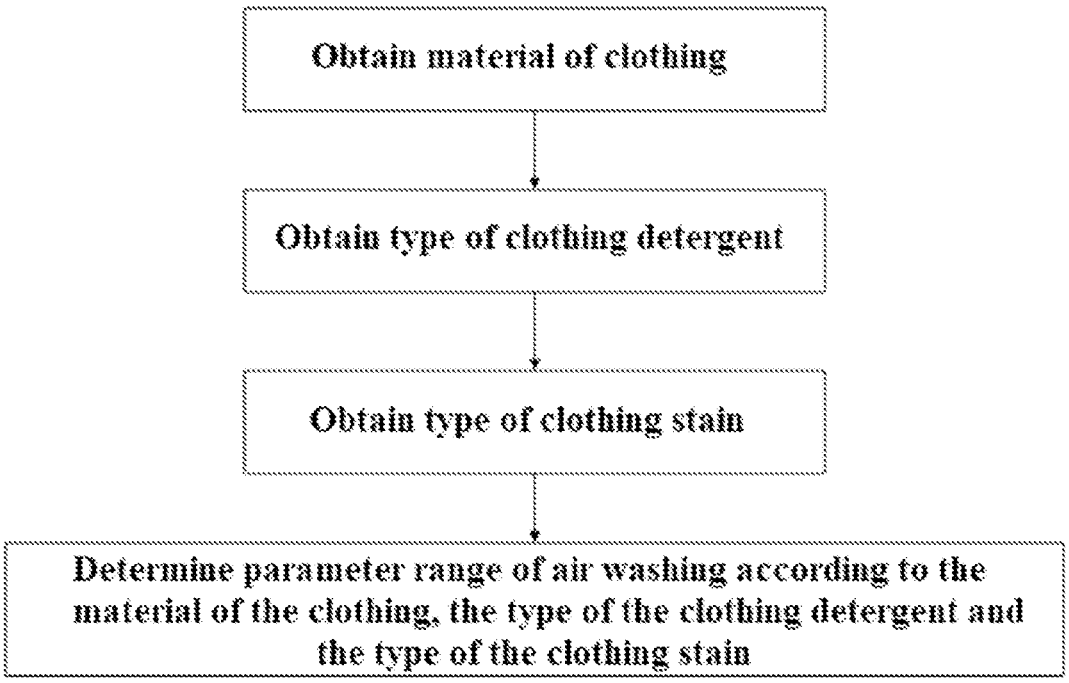
FIG. 1 is a flowchart of a control method of the present disclosure.

As shown in FIG. 1, the control method of the present disclosure includes: obtaining a material of the clothing; obtaining a type of a clothing detergent; obtaining a type of a clothing stain; and determining a parameter range of air washing according to the material of the clothing, the type of the clothing detergent and the type of the clothing stain. The parameter of air washing may be temperature, that is, a temperature range of air washing is determined by the material of the clothing, the type of the clothing detergent, and the type of the clothing stain; in addition, the parameter of air washing may also be humidity, that is, a humidity range of air washing is determined by the material of the clothing, the type of the clothing detergent, and the type of the clothing stain; or, the parameter of air washing includes temperature and humidity at the same time, that is, a temperature range and a humidity range of air washing are determined by the material of the clothing, the type of the clothing detergent, and the type of the clothing stain. Of course, the parameter of air washing may also be another parameter such as wind speed and air volume. Those skilled in the art may flexibly set the specific parameter of air washing in practical applications, and such adjustments and changes to specific parameters do not deviate from the principle and scope of the present disclosure. A very accurate mapping relationship can be set by the three parameter conditions of the material of the clothing, the type of the clothing detergent, and the type of the clothing stain, and a corresponding parameter range of air washing can be retrieved by a controller of the clothing treatment apparatus following the set mapping relationship. Of course, due to the various types of the material of the clothing, the clothing detergent and the clothing stain, it is more preferable to determine the parameter range of air washing by introducing a calculation method. A detailed description is given below in combination with three embodiments.

First Embodiment

The parameter range of air washing is a temperature range of air washing, and the step of "determining the parameter range of air washing according to the material of the clothing, the type of the clothing detergent and the type of the clothing stain" specifically includes: obtaining an optimal temperature treatment range corresponding to a current clothing material according to the material of the clothing; obtaining an optimal temperature treatment range corresponding to a current detergent type according to the type of the clothing detergent; obtaining an optimal temperature treatment range corresponding to a current stain type according to the type of the clothing stain; and performing an intersection operation on the optimal temperature treatment range corresponding to the current clothing material, the optimal temperature treatment range corresponding to the current detergent type, and the optimal temperature treatment range corresponding to the current stain type, and deriving the temperature range of the air washing according to the result of the intersection operation. In a possible situation, for example, the optimal tolerable temperature range or treatment temperature range corresponding to the current clothing material is 50° C. to 60° C., the optimal temperature treatment range (for example, the optimal activation temperature range) corresponding to the current detergent type is 48° C. to 58° C., and the optimal temperature treatment range corresponding to the current stain type is 52° C. to 62° C. After performing an intersection operation on the three, the optimal temperature range of 52° C. to 58° C. of air washing is derived.

In the first embodiment, after the step of "deriving the temperature range of the air washing according to the result of the intersection operation", the control method further includes: air washing the clothing at a preset temperature, the preset temperature being the lowest temperature within the temperature range of the air washing. Still in the above example, the clothing should be air washed at a preset temperature of 52° C., because at this temperature, not only the optimal air washing effect on the clothing can be ensured, but also a heating element can heat the air at the lowest temperature to avoid excessive energy consumption and make the clothing treatment apparatus more energy-saving.

Second Embodiment

The parameter range of air washing is a humidity range of air washing, and the step of "determining the parameter range of air washing according to the material of the clothing, the type of the clothing detergent and the type of the clothing stain" specifically includes: obtaining an optimal humidity treatment range corresponding to a current clothing material according to the material of the clothing; obtaining an optimal humidity treatment range corresponding to a current detergent type according to the type of the clothing detergent; obtaining an optimal humidity treatment range corresponding to a current stain type according to the type of the clothing stain; and performing an intersection operation on the optimal humidity treatment range corresponding to the current clothing material, the optimal humidity treatment range corresponding to the current detergent type, and the optimal humidity treatment range corresponding to the current stain type, and deriving the humidity range of the air washing according to the result of the intersection operation. In a possible situation, for example, the optimal tolerable humidity range or treatment humidity range corresponding to the current clothing material is 30% to 40%, the optimal humidity treatment range (for example, the optimal activation humidity range) corresponding to the current detergent type is 28% to 38%, and the optimal humidity treatment range corresponding to the current stain type is 32% to 42%. After performing an intersection operation on the three, the optimal humidity range of 32% to 38% of air washing is derived.

In the second embodiment, after the step of "deriving the humidity range of the air washing according to the result of the intersection operation", the control method further includes: air washing the clothing at a preset humidity, the preset humidity being the lowest humidity within the humidity range of the air washing. Still in the above example, the clothing should be air washed at a preset humidity of 32%, because at this humidity, not only the optimal air washing effect on the clothing can be ensured, but also a humidifying element can humidify the air at the lowest humidity to avoid excessive energy consumption and make the clothing treatment apparatus more energy-saving.

Third Embodiment

The parameter range of the air washing includes a temperature range and a humidity range of air washing, and the step of "determining the parameter range of air washing according to the material of the clothing, the type of the clothing detergent and the type of the clothing stain" specifically includes: obtaining an optimal temperature treatment range corresponding to a current clothing material according to the material of the clothing; obtaining an optimal humidity treatment range corresponding to the current clothing material according to the material of the clothing; obtaining an optimal temperature treatment range corresponding to a current detergent type according to the type of the clothing detergent; obtaining an optimal humidity treatment range corresponding to the current detergent type according to the type of the clothing detergent; obtaining an optimal temperature treatment range corresponding to a current stain type according to the type of the clothing stain; obtaining an optimal humidity treatment range corresponding to the current stain type according to the type of the clothing stain; and performing an intersection operation on the optimal temperature treatment range corresponding to the current clothing material, the optimal temperature treatment range corresponding to the current detergent type, and the optimal temperature treatment range corresponding to the current stain type, performing an intersection operation on the optimal humidity treatment range corresponding to the current clothing material, the optimal humidity treatment range corresponding to the current detergent type, and the optimal humidity treatment range corresponding to the current stain type, and deriving the temperature range and the humidity range of the air washing according to the results of the intersection operations. In a possible situation, for example, the optimal tolerable temperature range or treatment temperature range corresponding to the current clothing material is 50° C. to 60° C., the optimal temperature treatment range (for example, the optimal activation temperature range) corresponding to the current detergent type is 48° C. to 58° C., and the optimal temperature treatment range corresponding to the current stain type is 52° C. to 62° C.; after performing an intersection operation on the three, the optimal temperature range of 52° C. to 58° C. of air washing is derived; the optimal tolerable humidity range or treatment humidity range corresponding to the current clothing material is 30% to 40%, the optimal humidity treatment range (for example, the optimal activation humidity range) corresponding to the current detergent type is 28% to 38%, and the optimal humidity treatment range corresponding to the current stain type is 32% to 42%; after performing an intersection operation on the three, the optimal humidity range of 32% to 38% of air washing is derived.

In the third embodiment, after the step of "deriving the temperature range and the humidity range of the air washing according to the results of the intersection operations", the control method further includes: air washing the clothing at a preset temperature and a preset humidity, the preset temperature being the lowest temperature within the temperature range of the air washing, and the preset humidity being the lowest humidity within the humidity range of the air washing. Still in the above example, the clothing should be air washed at a preset temperature of 52° C. and a preset humidity of 32%, because at this temperature and humidity, not only the optimal air washing effect on the clothing can be ensured, but also a heating element can heat the air at the lowest temperature and a humidifying element can humidify the air at the lowest humidity to avoid excessive energy consumption and make the clothing treatment apparatus more energy-saving.

It should be noted that in the present disclosure, obtaining the optimal temperature treatment range corresponding to the current clothing material according to the material of the clothing, obtaining the optimal humidity treatment range corresponding to the current clothing material according to the material of the clothing, obtaining the optimal temperature treatment range corresponding to the current detergent type according to the type of the clothing detergent, obtaining the optimal humidity treatment range corresponding to the current detergent type according to the type of the clothing detergent, obtaining the optimal temperature treatment range corresponding to the current stain type according to the type of the clothing stain, and obtaining the optimal humidity treatment range corresponding to the current stain type according to the type of the clothing stain, can each be realized through experiments; that is, when designing the clothing treatment apparatus, those skilled in the art may conduct experiments on the optimal treatment temperature and humidity for each type of clothing material, the optimal treatment temperature and humidity for each type of clothing detergent, and the optimal treatment temperature and humidity for each type of clothing stain to obtain the corresponding data. Alternatively, those skilled in the art may obtain the above-mentioned data based on experience.

In addition, it should also be noted that in the present disclosure, the steps of "obtaining the material of the clothing", "obtaining the type of the clothing detergent" and "obtaining the type of the clothing stain" may be flexibly adjusted. This adjustment does not constitute a limitation to the present disclosure. In addition, the way of obtaining the material of the clothing may be implemented through manual input (that is, the user inputs clothing material information to the controller of the clothing treatment apparatus through a control panel of the clothing treatment apparatus), or through RFID recognition, or through image recognition. Similarly, the way of obtaining the type of the clothing detergent and the way of obtaining the type of the clothing stain may also be implemented through manual input, or through RFID recognition, or through image recognition. Those skilled in the art may flexibly set the ways of obtaining the material of the clothing, the type of the clothing detergent, and the type of the clothing stain in practical applications. Such adjustment and changes do not deviate from the principle and scope of the present disclosure.

Preferably, before the step of "obtaining the type of the clothing detergent", the control method of the present disclosure further includes: applying the clothing detergent to the clothing. The way of applying the clothing detergent to the clothing may be manual application, or the clothing treatment apparatus may inject/spray the clothing detergent in an automatic manner The change of the application method does not constitute a limitation to the present disclosure.

Preferably, after the air washing operation is performed on the clothing, the control method of the present disclosure further includes: applying a clothing nursing agent to the clothing. Similar to the above, the way of applying the clothing nursing agent to the clothing may be manual application, or the clothing treatment apparatus may inject/spray the clothing nursing agent in an automatic manner The change of the application method does not constitute a limitation to the present disclosure.

Preferably, in the process of performing the air washing operation on the clothing, the control method of the present disclosure further includes: turning the clothing over. For example, a clothing turning device (such as a drum) is arranged in the cabinet of the clothing treatment apparatus, so that the clothing can be turned back and forth under the action of the rotation of the drum, thus enabling the clothing to fully contact with an inner wall of an inner cylinder of the drum through friction; moreover, combined with the effect of air washing, impurities such as dust and stain on the clothing can be quickly removed.

Hereinafter, a preferred embodiment of the present disclosure will be further explained in combination with a washing machine with air washing function and manual input.

Figure 2:
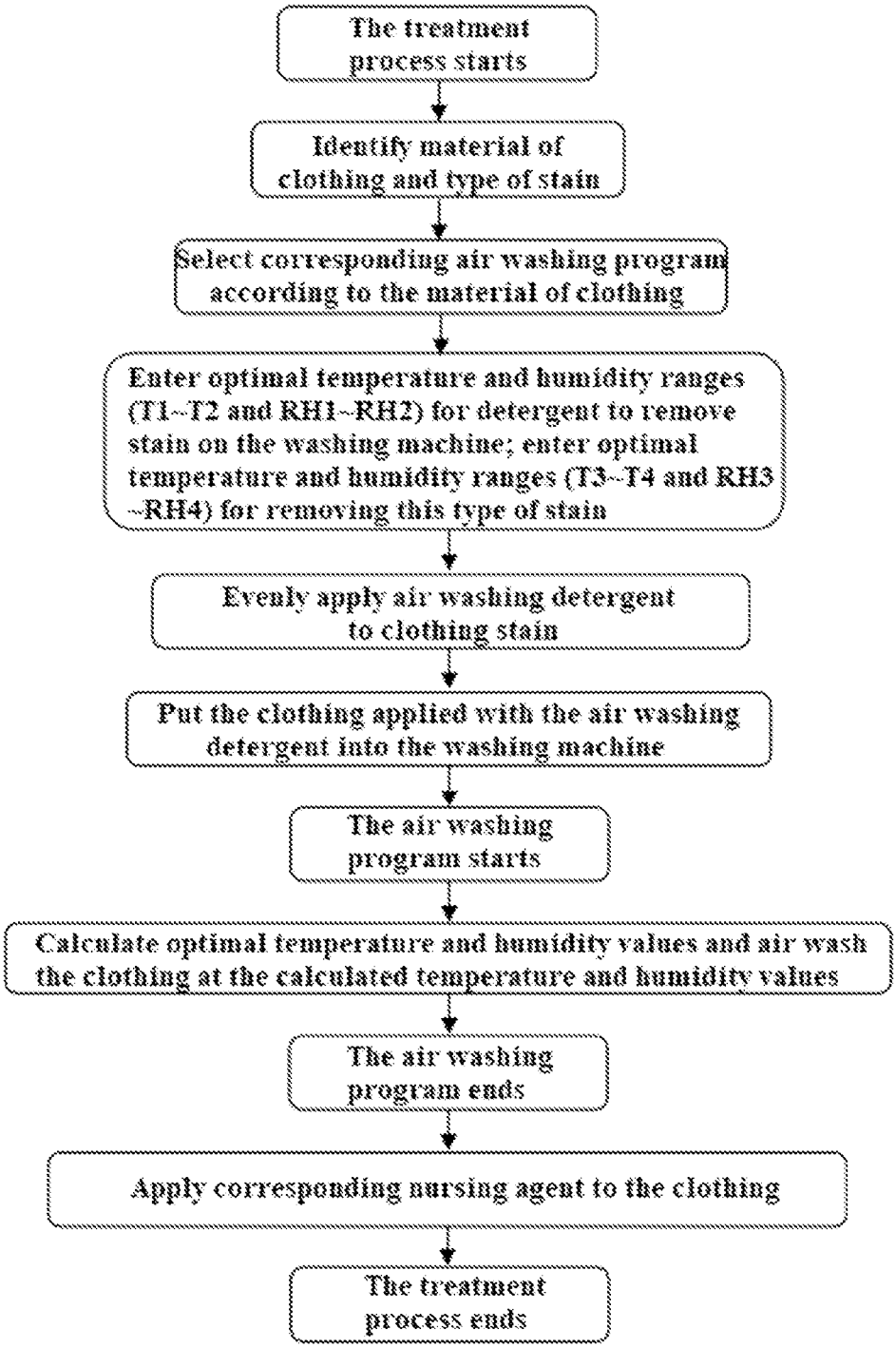
FIG. 2 is a flowchart of an embodiment of the control method of the present disclosure.

As shown in FIG. 2, after the washing machine is turned on, the washing machine first identifies the material of the clothing and the type of the clothing stain; then, the air washing program is selected according to the material of the clothing, and the optimal temperature and humidity ranges (T1~T2 and RH1~RH2) for the detergent to remove the stain are entered on the washing machine; the optimal temperature and humidity ranges (T3~T4 and RH3~RH4) for removing this type of stain are entered, then the air washing detergent is evenly applied to the clothing stain, and the clothing applied with the air washing detergent is put into the washing machine; the air washing program starts, and the washing machine calculates the optimal temperature and humidity values and air washes the clothing at these temperature and humidity values; after the air washing is completed, the clothing nursing agent is applied to the clothing.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A control method for a clothing treatment apparatus, the clothing treatment apparatus comprising an air washing device capable of performing air washing on clothing, and the control method comprising:

obtaining a material of the clothing;

obtaining a type of a clothing detergent;

obtaining a type of a clothing stain; and determining a parameter range of air washing according to the material of the clothing, the type of the clothing detergent and the type of the clothing stain, wherein the parameter range of the air washing is a humidity range of air washing, and the determining the parameter range of air washing according to the material of the clothing, the type of the clothing detergent and the type of the clothing stain comprises:

obtaining an optimal humidity treatment range corresponding to a current clothing material according to the material of the clothing;

obtaining an optimal humidity treatment range corresponding to a current detergent type according to the type of the clothing detergent;

obtaining an optimal humidity treatment range corresponding to a current stain type according to the type of the clothing stain; and performing an intersection operation on the optimal humidity treatment range corresponding to the current clothing material, the optimal humidity treatment range corresponding to the current detergent type, and the optimal humidity treatment range corresponding to the current stain type, and deriving the humidity range of the air washing according to the result of the intersection operation, or wherein the parameter range of the air washing comprises a temperature range and a humidity range of air washing, and the determining the parameter range of air washing according to the material of the clothing, the type of the clothing detergent and the type of the clothing stain comprises:

obtaining an optimal temperature treatment range corresponding to a current clothing material according to the material of the clothing;

obtaining an optimal humidity treatment range corresponding to the current clothing material according to the material of the clothing;

obtaining an optimal temperature treatment range corresponding to a current detergent type according to the type of the clothing detergent;

obtaining an optimal humidity treatment range corresponding to the current detergent type according to the type of the clothing detergent;

obtaining an optimal temperature treatment range corresponding to a current stain type according to the type of the clothing stain;

obtaining an optimal humidity treatment range corresponding to the current stain type according to the type of the clothing stain; and performing an intersection operation on the optimal temperature treatment range corresponding to the current clothing material, the optimal temperature treatment range corresponding to the current detergent type, and the optimal temperature treatment range corresponding to the current stain type, performing an intersection operation on the optimal humidity treatment range corresponding to the current clothing material, the optimal humidity treatment range corresponding to the current detergent type, and the optimal humidity treatment range corresponding to the current stain type, and deriving the temperature range and the humidity range of the air washing according to the results of the intersection operations.

2. The control method according to claim 1, wherein after the deriving the humidity range of the air washing according to the result of the intersection operation, the control method further comprises:

air washing the clothing at a preset humidity, the preset humidity being the lowest humidity within the humidity range of the air washing.

3. The control method according to claim 1, wherein after the step of deriving the temperature range and the humidity range of the air washing according to the results of the intersection operations, the control method further comprises:

air washing the clothing at a preset temperature and a preset humidity, the preset temperature being the lowest temperature within the temperature range of the air washing, and the preset humidity being the lowest humidity within the humidity range of the air washing.

4. The control method according to claim 1, wherein before the obtaining the type of the clothing detergent, the control method further comprises:

applying the clothing detergent to the clothing.

* * * * *